US006773642B1

(12) United States Patent
Wardell

(10) Patent No.: US 6,773,642 B1
(45) Date of Patent: Aug. 10, 2004

(54) METHOD OF FORMING A CONCRETE RETAINING WALL BLOCK IN A FRONT FACE UP POSITION

(76) Inventor: Michael James Wardell, 2316 12th Pl. SE., Puyallup, WA (US) 98374

( * ) Notice: Subject to any disclaimer, the term of this patent is extended or adjusted under 35 U.S.C. 154(b) by 179 days.

(21) Appl. No.: 10/036,345

(22) Filed: Jan. 4, 2002

(51) Int. Cl.[7] ..... B28B 1/093; B28B 3/04; B28B 3/08; B28B 7/20; B28B 1/087

(52) U.S. Cl. ..... 264/71; 264/293; 264/297.9; 264/318; 264/333; 264/336; 405/286; 425/253; 425/356; 425/414; 425/431; 425/432; 425/452; 425/468

(58) Field of Search ..... 264/71, 297.9, 264/336, 318, 293, 333; 405/286; 425/253, 356, 414, 431, 432, 452, 468

(56) References Cited

U.S. PATENT DOCUMENTS 1,635,093 A * 7/1927 McPherson et al. ..... 264/256
2,614,310 A * 10/1952 Maxwell ..... 249/176
3,587,143 A * 6/1971 Sonneville ..... 425/100
3,955,907 A * 5/1976 Yamasita et al. ..... 425/130
3,981,953 A * 9/1976 Haines ..... 264/163
4,063,866 A * 12/1977 Lurbiecki ..... 425/517
4,098,865 A * 7/1978 Repasky ..... 264/333
4,869,660 A * 9/1989 Ruckstuhl ..... 425/195
4,886,633 A * 12/1989 Rook et al. ..... 264/219
5,017,049 A * 5/1991 Sievert ..... 405/284
5,082,438 A * 1/1992 Rook et al. ..... 425/358
5,320,790 A * 6/1994 Lowe ..... 264/31
5,484,236 A * 1/1996 Gravier ..... 405/286
6,168,354 B1 * 1/2001 Martin et al. ..... 405/284
6,322,742 B1 * 11/2001 Bott ..... 264/297.9
6,557,818 B2 * 5/2003 Manthci ..... 249/171

* cited by examiner

*Primary Examiner*—Michael Colaianni
*Assistant Examiner*—Michael I. Poe

(57) ABSTRACT

A method of forming a concrete retaining wall block having a front face and an opposed back face in a front fact up position. The method includes inserting a plurality of tines of a horizontal core puller into a plurality of holes in the bottom of a mold such that the a plurality of tines are positioned to form a dovetail slot and chamfers in the back face of a concrete retaining wall block; and pressing and vibrating a semi-dry concrete mix feed into the mold with a head to form a concrete retaining wall block having a relief stamped in its front face and to form the dovetail slot and chamfers its back face. The method allows the dimensions of the concrete retaining wall block to be exact and consistent from cycle to cycle of the method.

7 Claims, 5 Drawing Sheets

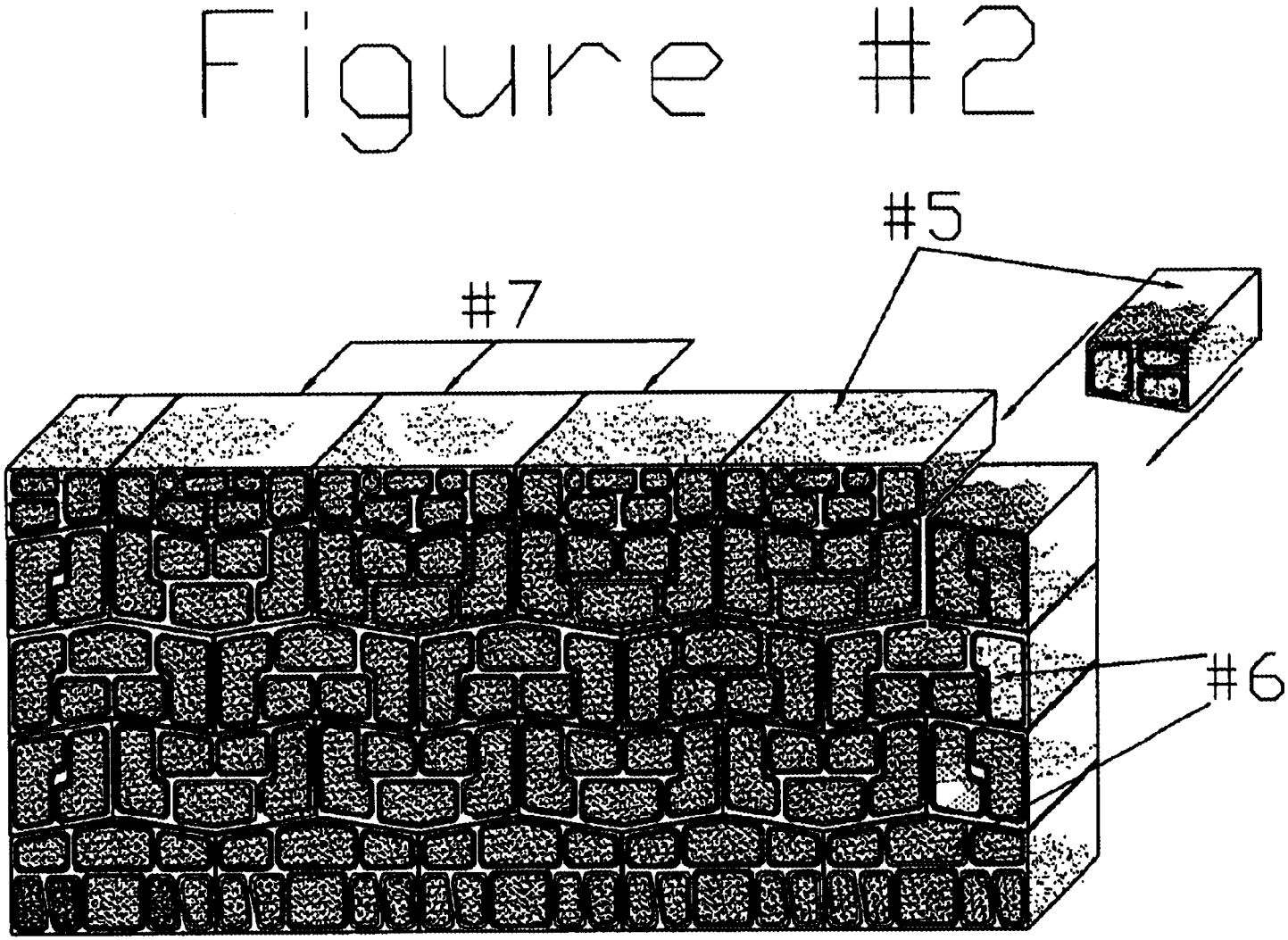
Figure #2

METHOD OF FORMING A CONCRETE RETAINING WALL BLOCK IN A FRONT FACE UP POSITION

Background of Invention: Most concrete retaining wall products produced today are, manufactured on concrete product machines, (e.g. block machines or raver machines) and are of a split face design (e.g. Siamese manufactured and then split into two or more products) with some type of core hole or protrusion on the product to either lock the product in place or offset it as it is dry stacked in place. Historically retaining wall products are manufactured standing upright in a mold with the face of the unit unseen until the product is stripped from the mold and split in two or more pieces. Because of the way existing concrete products have to be manufactured in an upright position and the inability to put a relief or design on the face of the unit, all retaining wall products are manufactured in basically the same manner. In the production of retaining wall, a set height stopping point, set into the manufacturing machine, determines the height of the product. This process typically has room for errors (e.g. variance of heights) cycle to cycle. When standard masonry units are laid up, they had been manufactured to nominal height and the difference is made up with mortar. In the case of retaining wall units, they are made to exact (still a variance occurs) height and dry stacked. Any variance is magnified as the height of the wall increases. This variance is usually the reason for rejection of the product.

SUMMARY OF INVENTION

This new design is how the product is manufactured and the face is imprinted. This new process makes the product in the face up position with the face or relief being stamped into the product. This concept is totally new to the manufacture of concrete retaining wall products because it makes the relief or rock face design with the stripper shoes and is not split afterwards. By manufacturing the product in this new way the dimensions of the product are exact and consistent cycle to cycle. Any variation in the height of the product would show up on the face of the unit and not make any difference to the integrity of the wall. The design of the units is also unique to retaining wall products.

BRIEF DESCRIPTION OF DRAWINGS

FIG. 2 is a side view of a sample wall showing how retaining wall units are placed together;

DETAILED DESCRIPTION

Figure 1:
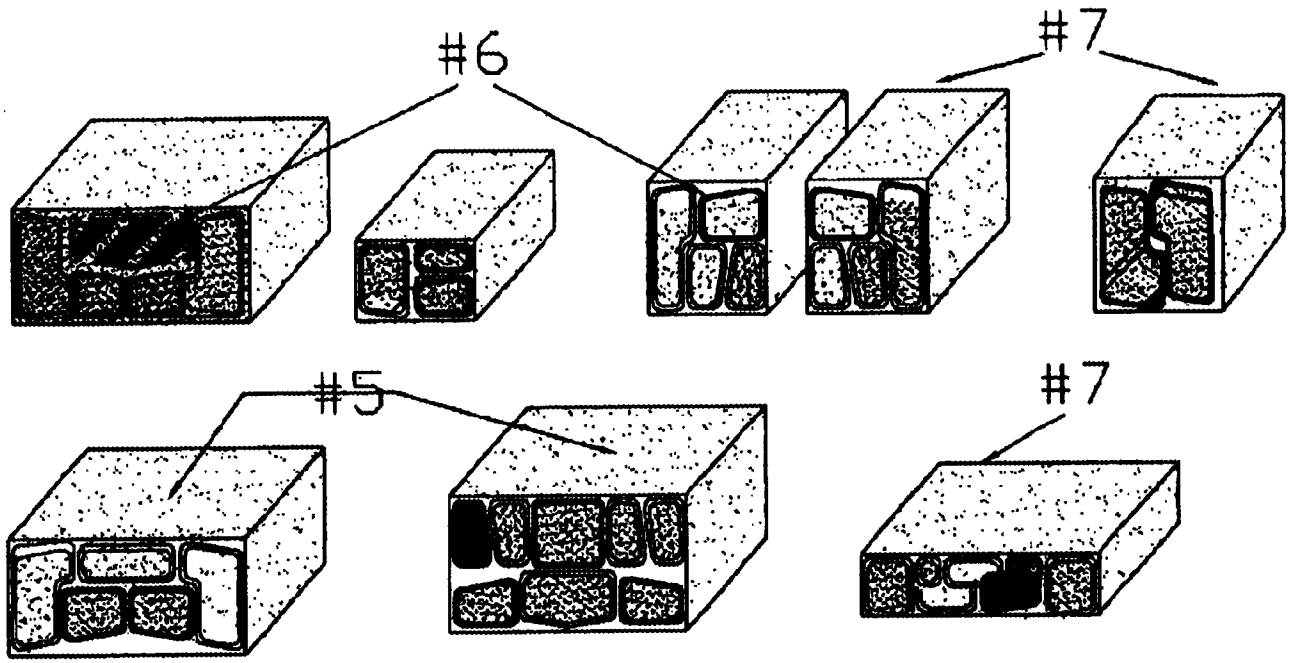
FIG. 1 is a top view of different configurations of retaining wall units used to lay up a wall.
Figure 3A:
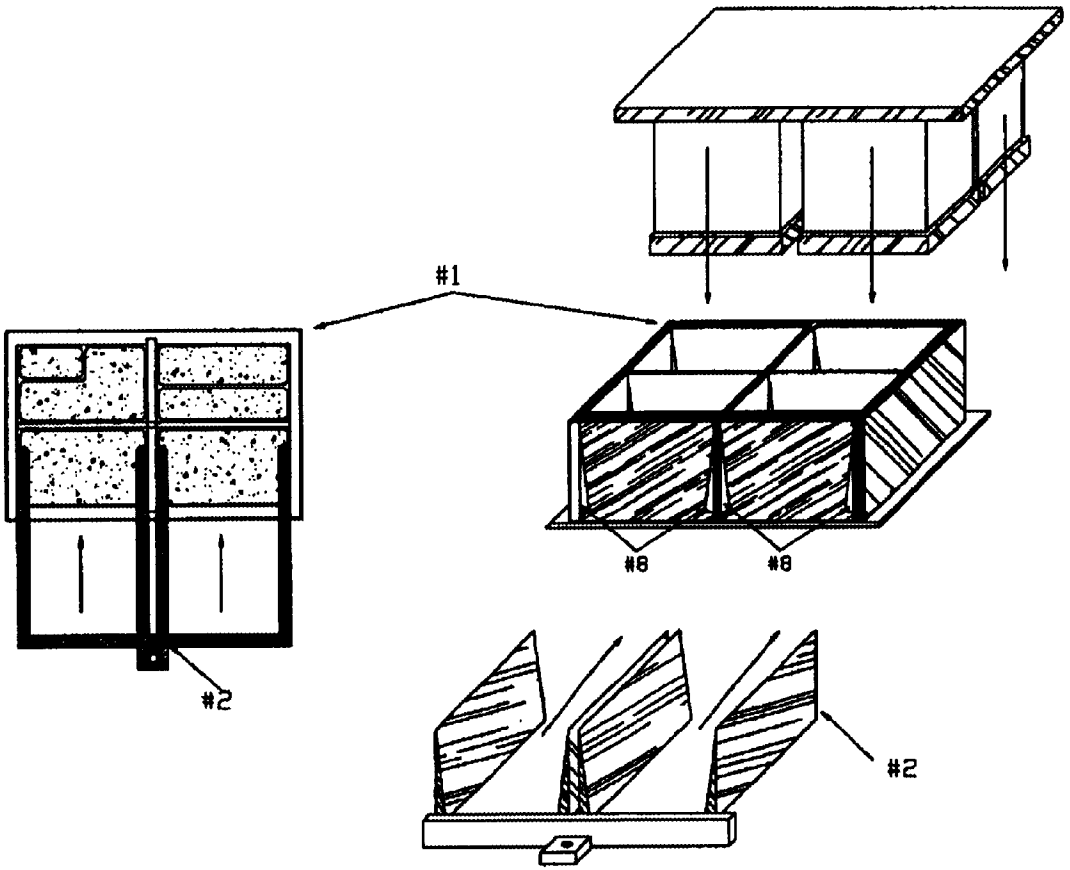
FIG. 3*a* is a top view of the mold showing how the horizontal cores are arranged.
Figure 3B:
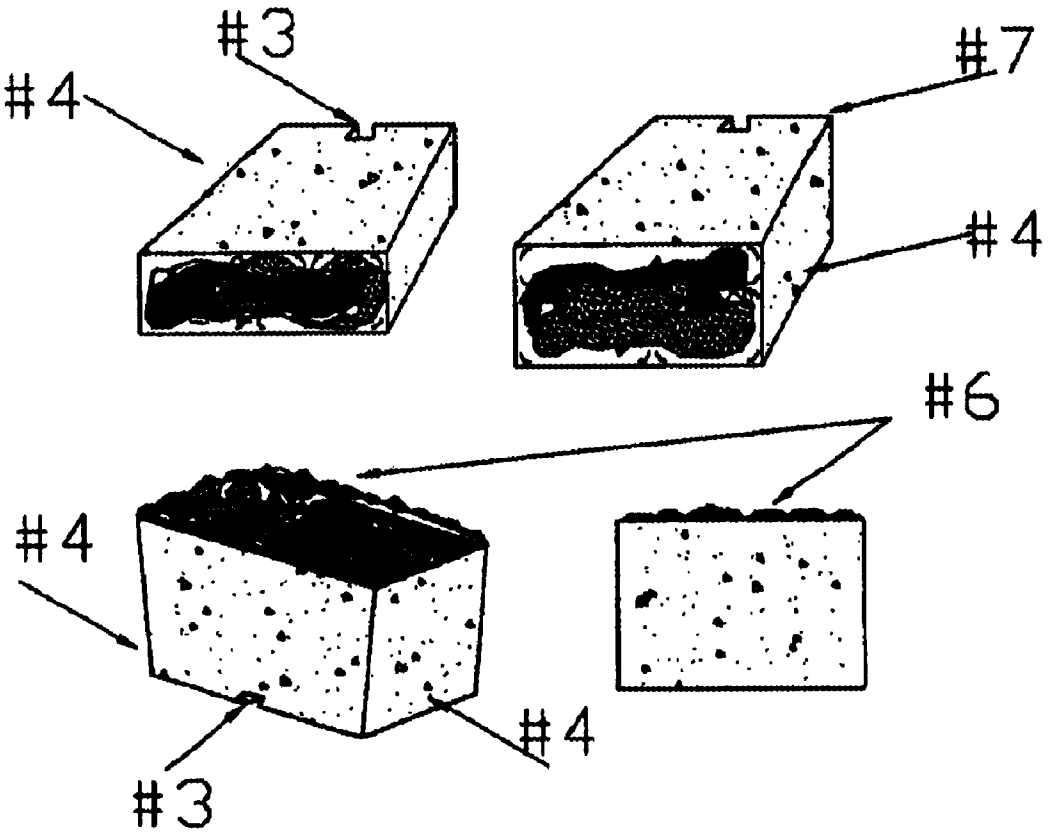
FIG. 3*b* is an end view of retaining wall units.
Figure 4:
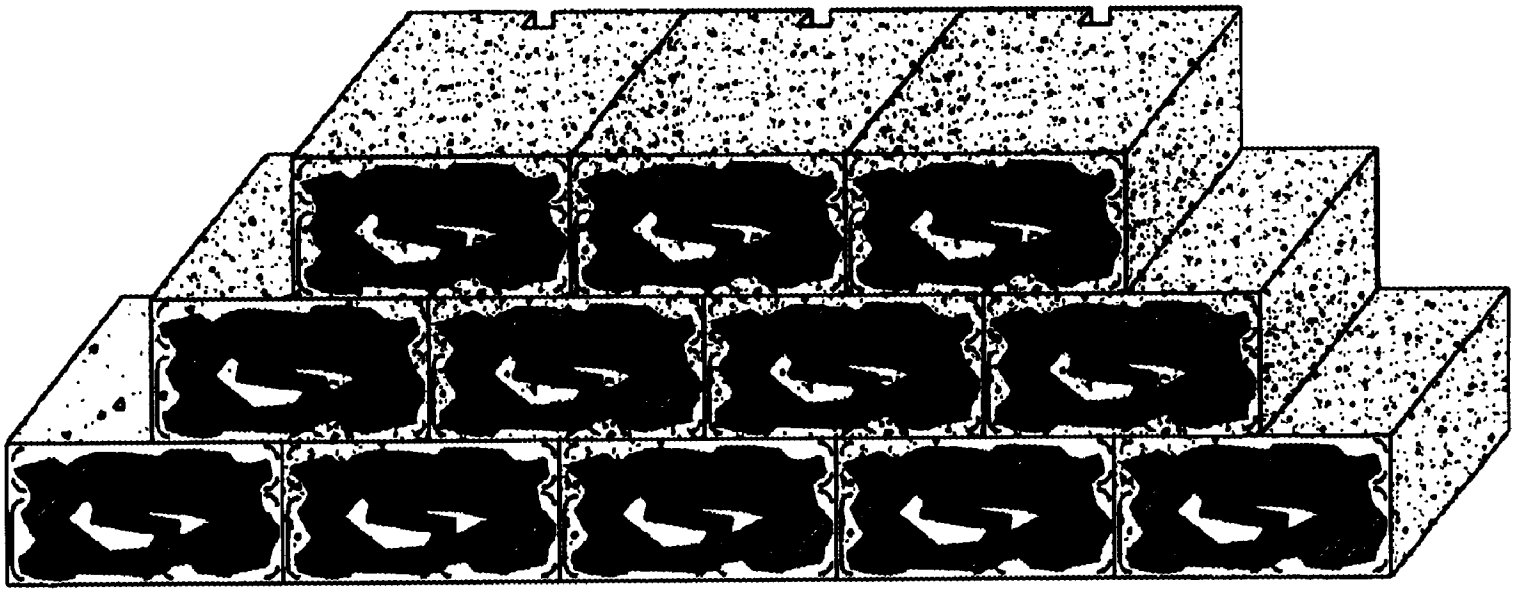
FIG. 4 is a side view of a sample wall showing a stone face impressed into the face of the wall.

In the manufacture of all concrete masonry units whether it be on a Besser, Columbia, Steams, Omag, Hess, Reikers, Flemming, Zenith, Masa, Knuar, Tiger or any other manufacturer of concrete products machines and (some of which are called block machines,) some are called paver machines, the sequence of operation and concept of manufacture is the same. The products are made in a mold. The size and configuration will vary depending on the product being produced. There are hundreds of different products and variations on each product. There can be a variation of the materials used in the manufacture of the concrete products. This variation is because of the type of product being manufactured and the availability of aggregates in the area, however, all use a combination of cement, aggregates (e.g. sand/ gravel/cinders, etc.) and water to prepare into a semi-dry mix. There may also be some admix or color added to the mix. The sequence of operation is:

1. A mold is placed in the machine;
2. A pallet, either metal or wood, is positioned under and tight against the bottom of the mold;
3. The machine cycles to a point where a feedbox is positioned over the mold;
4. Concrete material is dropped or vibrated from the feedbox into the mold;
5. A head, containing shoes, is pressed and vibrated into the mold to compact the materials into the mold;
6. After a time or setting is reached (e.g. the product is still uncured but solid enough to stay together in its molded shape) the machine cycles to a position to strip or push the compacted product from the mold;
7. The product is left on a pallet until it is cured enough to be handled;
8. After the product is cured enough to be handled, it is removed from the pallet and the cycle starts over again.

The amount of cycles a machine can make in a day varies from machine to machine and the type of product being manufactured.

In the process of stripping or pushing the product from the mold, the sides of the mold have to be straight up and down or tapered out. You cannot press a product through a smaller dimension opening on the bottom than the top. The product would not come out intact. And, there is no way to push the product from the bottom up. Because of the way the product has to be removed from the mold, the only product made today with an imprinted top is a paver or stepping stone and these have straight sides and cannot be used for retaining walls. Because of the restrictions on what products can be produced this way, retaining wall products have not produced in this manner.

My design incorporates the use of a horizontal core puller in conjunction with a concrete products machine to put a chamfer 4 on the ends of block 5 and a dovetail slot 3 on the back or pallet side of the block 5. A horizontal core puller is a piece of equipment that attaches to the front, side or back of the concrete products machine and utilizes fingers or lines 2, that are inserted into a mold 1, to make a slot, groove or hole (e.g., a dovetail slot 3 or a chamfer 4) in the back face 7 of the block 5 being manufactured. These fingers or tines 2 are inserted mechanically through holes 8 in the side of the mold 1 at the bottom of the mold 1 before the concrete mix is put into mold 1. They stay in position until the block 5 is finished molding and then are pulled backwards from the mold 1 prior to stripping the block 5 from the mold 1. The use of the core puller allows the block 5 to be manufactured at any height desired. Retaining wall blocks 5 need to be at least six inches deep, from front face 6 to back face 7, to be any use. This design allows for the manufacture of blocks 5 from six to twelve inches deep from front face 6 to back face 7. Numerous designs can be impressed into the front face 6 of the retaining wall blocks 5 by pressing a head containing at least one shoe against the top surface of the concrete mix in the mold 5. Retaining wall blocks have to be easily made and capable of being laid in a radius to be of any significant value. The known processes do not allow for the front face to be impressed into a block. The known processes also depend on the precision of the machine to make a block at a consistent height. With my design, the height of the block 5 is determined by the precision of the mold 1, which is manufactured to high tolerances. The blocks 5 can be made fast and economically using my process. Retaining wall blocks 5 are dry stacked to form walls as opposed to using mortar between th joints. The tolerances have to be very close for the heights of the blocks 5 to form a wall. My design allows for these closer tolerances.

What I claim as my invention is:

1. A method of forming a concrete retaining wall block having a front face and an opposed back face in a front face up position comprising:

providing a mold having at least one hole for receiving at least one associated tine of a horizontal core puller;

inserting the at least one tine in the associated at least one hole;

positioning a feedbox containing a semi-dry concrete mix over the mold;

feeding the concrete mix from the feedbox into the mold;

pressing and vibrating the concrete mix in the mold with a head comprising at least one shoe to form a concrete retaining wall block;

allowing the concrete retaining wall block to set within the mold until the concrete retaining wall block is solid enough to stay together;

removing the at least one tine from the mold by pulling the at least one tine backwards from the mold;

stripping the concrete retaining wall block from the mold; and allowing the concrete retaining wall block to cure;

wherein the improvement comprises:

inserting the at least one tine into the associated at least one hole wherein the at least one hole is located at a bottom of the mold and wherein the at least one tine is positioned to form at least one slot in the back face of the concrete retaining wall block;

providing a head comprising at least one shoe for stamping a relief in the front face of the concrete retaining wall block; and pressing and vibrating the concrete mix in the mold with the head by inserting the head into a top of the mold to form a concrete retaining wall block in the front face up position such that the front face of the concrete retaining wall block is stamped with the relief by pressing the at least one shoe of the head against a top surface of the concrete mix and the at least one slot is formed in the back face of the concrete retaining wall block.

2. The method of forming a concrete retaining wall block according to claim 1 further comprising:

positioning a pallet made of metal or wood under and tight against the bottom of the mold prior to inserting the at least one tine in the associated at least one hole in the bottom of the mold.

3. The method of forming a concrete retaining wall block according to claim 1 wherein the dimensions of the concrete retaining wall block are exact and consistent from cycle to cycle of the method.

4. The method of forming a concrete retaining wall block according to claim 1 wherein the at least one slot is selected from the group consisting of dovetail slot, chamfer and combinations thereof.

5. The method of forming a concrete retaining wall block according to claim 4 wherein the at least one slot comprises a dovetail slot.

6. The method of forming a concrete retaining wall block according to claim 4 wherein the at least one slot comprises a plurality of slots.

7. The method of forming a concrete retaining wall block according to claim 6 wherein the plurality of slots comprises a dovetail slot and chamfer.

* * * * *